US006244936B1

(12) United States Patent
Kao et al.

(10) Patent No.: US 6,244,936 B1
(45) Date of Patent: Jun. 12, 2001

(54) METHOD AND DEVICE FOR REDUCING SEMICONDUCTOR DEFECTS CAUSED BY WAFER CLAMPING

(75) Inventors: Tsung-En Kao, Tour-Fenn Town; Ming-Tsong Wang, Taipei, both of (TW)

(73) Assignee: Taiwan Semiconductor Manufacturing Company, Ltd, Hsinchu (TW)

( * ) Notice: Subject to any disclaimer, the term of this patent is extended or adjusted under 35 U.S.C. 154(b) by 0 days.

(21) Appl. No.: 09/451,971

(22) Filed: Nov. 30, 1999

(51) Int. Cl.[7] ..... B24B 1/00

(52) U.S. Cl. ..... 451/51; 451/41; 451/286; 451/287; 451/288

(58) Field of Search ..... 451/41, 51, 286, 451/287, 288

(56) References Cited

U.S. PATENT DOCUMENTS

| | | | | |
|---|---|---|---|---|
| 5,421,401 | * | 6/1995 | Sherstinsky et al. | 165/80.2 |
| 5,614,446 | * | 3/1997 | Ramaswami et al. | 437/228 |
| 5,725,718 | * | 3/1998 | Banholzer et al. | 156/345 |
| 5,938,884 | * | 8/1999 | Hoshizaki et al. | 156/345 |
| 6,110,025 | * | 8/2000 | Williams et al. | 451/286 |
| 6,116,992 | * | 9/2000 | Prince | 451/286 |

* cited by examiner

*Primary Examiner*—Joseph J. Hail, III
*Assistant Examiner*—Shantese McDonald
(74) *Attorney, Agent, or Firm*—Tung & Associates

(57) ABSTRACT

Defects in semiconductor wafers caused by a wafer clamp ring are reduced by polishing the surfaces of the clamp ring that engage and apply clamping force to the wafer. A polishing tool includes a circular plate supported on the stationary base. A layer or pad of polishing material, such as silicon carbide diamond, is deposited over the plate. The clamp ring is placed on the plate such that clamping surfaces of the ring engage the polishing material on the plate, and the ring is rotated to effect polishing of the clamping surfaces.

13 Claims, 4 Drawing Sheets

METHOD AND DEVICE FOR REDUCING SEMICONDUCTOR DEFECTS CAUSED BY WAFER CLAMPING

FIELD OF THE INVENTION

The present invention broadly relates to semiconductor manufacturing equipment, and deals more particularly with a method and device for reducing defects in semiconductor wafers caused by clamps used to clamp the wafer in place during fabrication processing of the wafer.

BACKGROUND OF THE INVENTION

The fabrication of semiconductor devices on substrates typically requires the deposition of multiple metal, dielectric and semiconductor film layers on the surface of the substrate. The film layers are typically deposited onto the substrate in vacuum chambers. Certain processing operations require that the deposition of multiple film layers or the etching of a previously deposited film layer. During these processing steps, it is necessary to properly align and secure the substrate in the processing chamber in which the desired deposition or etch process is performed.

Typically, the substrate is supported in the chamber on a support member, commonly referred to as a pedestal. The substrate is placed on, and secured to the upper surface of the pedestal prior to the deposition or etch process. In one process, metal may be deposited onto the back side of the substrate following processing of the front side of the substrate. During this type of processing operation, the substrate is supported on rest buttons which extend from the upper surface of the support member to reduce the surface area contact between the substrate and the support member. The rest buttons are sized and positioned to locate the substrate at a desired location in the chamber. To ensure proper processing of the substrate, the substrate must be properly aligned relative to the support member and a generally planar surface must be presented for the receipt of the deposition layer. The position of the support member in the chamber is selected to provide a desired spacing and relative geometry between the generally planar surface of the substrate and portions of the process chamber. In a sputter deposition process, for example, the position and alignment of the substrate is selected to present a planar surface of the substrate co-planar to the planar target surface, and at a distance from the target which is selected to provide uniform thickness deposition on the substrate.

Substrates onto which film layers are deposited may be extremely thin. Thin substrates tend to warp or take on a "potato chip" profile. When the substrate warps, it no longer presents a generally planar surface to receive deposition material. The warped surface of the substrate results in a non-co-planar relationship between the substrate and the target, and variable spacing therebetween. Consequently, in applications where substrates have become bowed, the substrates must be flatted before they are exposed to the deposition environment. Otherwise, non-uniform thickness deposition of the film layer may result.

In order to hold the substrate in a fixed position and to flatten warped substrates, a clamp ring is used to clamp the substrate (wafer) to the pedestal. Care must be taken in securing the substrate so that the substrates not damaged by the clamp ring. Clamp rings must be positioned both laterally and vertically relative to the substrate to ensure that the substrates are not damaged under the weight of the clamp ring or by contact between a misaligned substrate and a clamp ring as the substrate contacts the clamp ring.

Typically, clamp rings also function to assist in aligning the wafer on the support member. To achieve such alignment, the clamp ring is provided with wing members that extend downwardly and outwardly from the clamp ring in order to funnel the substrate into alignment with the clamp ring and the pedestal. Consequently, vertical and lateral forces are applied to the substrate as the wing member achieves lateral alignment and the clamping portion simultaneously achieves vertical alignment of the substrate, clamp ring and pedestal as the clamp ring settles onto the pedestal.

In processing systems such as CVD, PVD, and etch processes, clamp rings also provide shielding to prevent airborne materials from depositing on the interior surfaces of the chamber. Shield arrangements have been devised to restrict the processing environment to a region adjacent to the surface of the substrate. A typical shield system includes a fixed wall portion which extends between the outer chamber cover at a position within the chamber where the pedestal is positioned during a processing period. The fixed wall portion extends around the circumference of the pedestal when the pedestal is positioned for processing, and thus blocks access of the processing environment to the walls and interior components with the chamber.

Several designs of clamp rings have been devised in the past to suit the needs of processing operations and geometries of specific processing chambers. Clamp rings may be either continuous rings which engage the entire peripheral top surface of a wafer, or intermittent finger-like pads which peripherally engage portions of the top surface of the wafer and urge it against the underlying pedestal.

The application of clamping pressure by surfaces of the clamp that engages the periphery of the wafer can result in several processing problems that affect the quality of the processed wafer. For example, moving contact between the clamp ring and the outer edge of the wafer during the clamping process sometimes results in small pieces of the wafer being broken off which are then carried onto the surface of the wafer during processing of either that, or subsequent wafers. Such particles act as contaminants on the wafer surface, which become buried in the wafer during subsequently deposition processes. Such defects can result in streamlines, crazing, metal photo-defocusing during subsequently processing and metal line ridging, all of which reduce yield and through put of the processing operation.

Similar defects can result from imperfections in the pad surfaces on the clamp ring that engage the outer peripheral face of the wafer. Such imperfections result in stress points in the wafer's periphery that cause crazing or cracking in the wafer, and sometimes result in breaking off small particles from the wafer which migrate onto the surface of the wafer as contaminant particles, as discussed above. This entire problem is enhanced when gas is injected into a space between the backside of the wafer and the pedestal. Such gas, which is usually an inert gas such as Argon, is used to ensure uniform heating of the wafer and results in additional pressure being applied between the wafer's periphery and the clamp ring.

It would therefore be highly desirable to improve the clamping process and associated clamp ring in a manner that would reduce the type of product defects discussed above.

SUMMARY OF THE INVENTION

According to one aspect of the invention, a method is provided for reducing defects in a semiconductor wafer caused by a clamp ring used to clamp the edge of the wafer during processing, comprising polishing a surface of the clamp ring that is used to engage in clamping the wafer during a clamping operation. Polishing is preferably performed by placing the clamp ring on a polishing tool, with the clamp ring surface in face-to-face contact with a polishing surface on the tool, and relatively moving the clamp ring and the tool, whereby the polishing tool surface polishes the clamp ring surface. The relative movement between the polishing tool and the clamp ring is preferably performed by turning the clamp ring and the tool relative to each other. The method may also include the step of introducing a flowable abrasive material between the clamp ring surface and the tool to aid in polishing the clamp ring surface. The flowable abrasive material may comprise a silicon carbide diamond.

According to another aspect of the invention, a method is provided for reducing defects in a semiconductor wafer caused by a clamp ring used to clamp the edge of the wafer during processing of the wafer, comprising the steps of: providing a polishing tool having a flat, circular polishing surface; placing the clamp ring on the tool with the clamping pad surfaces of the ring in face-to-face contact with the polishing surface; and, relatively rotating the tool and the clamp ring whereby to polish the clamp ring surface. The method also preferably includes urging the clamp ring and the tool towards each other using an axial force, and wherein the rotational step is performed by rotating the clamp ring while the tool remains stationary. According to a further aspect of the invention, a method is provided for refurbishing a clamp ring used to clamp the edge of a semiconductor wafer during processing of the wafer, comprising the steps of: removing the clamp rings from apparatus used to process the wafer: cleaning the clamp ring; polishing a clamping surface of the ring used to engage a face of the wafer; and, reinstalling the clamp ring on the apparatus. The cleaning step may include washing and drying the ring, wherein the polishing step is performed after the ring has been dried. The step of cleaning the clamp ring includes, after polishing the ring, subjecting the ring to the sand spray.

According to still another aspect of the invention, a device is provided for polishing a clamp ring used to clamp a semiconductor wafer during processing derived, wherein the clamp ring includes a clamp surface used to engage one face of the wafer. The device includes a circular polishing member having a flat, outer peripheral polishing surface for engaging the clamp ring surface in face-to-face contact therewith, and means for supporting the polishing member. The polishing member preferably includes a rigid plate and wherein the polishing surface is defined by a layer of abrasive polishing material disposed on the plate. The abrasive polishing material is preferably a silicon carbide diamond. The layer of abrasive material may be in the form of a pad adhered to the plate. The supporting means may include a base having a maximum cross sectional dimension less than the inside diameter of the clamp ring.

Accordingly, it is the primary object of the invention to provide a method and device for polishing clamping surfaces of a clamp ring used to clamp a semiconductor wafer in place during a fabrication operation.

A further object of the invention is to provide a method and apparatus as described above which produces a highly polished clamping surface that results in a reduction of broken particles from the wafer that form contaminants adversely affecting the quality of the processed wafer.

Another object of the invention is to provide a method and device as described above which is particularly simple in terms of equipment and can be used by relatively unskilled operators to polish clamp rings.

A further object of the invention is to provide a method and device used for refurbishing a clamp ring which provides for polishing of the clamping surfaces of said ring during a refurbishing operation.

These, and further objects and advantages of the present invention will be made clear or will become apparent during the course of the following description of a preferred embodiment of the invention.

BRIEF DESCRIPTION OF THE DRAWINGS

In the drawings, which form an integral part of the specifications, and are to be read in conjunction therewith, and in which like reference numerals are employed to designate identical components in the various views.

DESCRIPTION OF THE PREFERRED EMBODIMENT

Figure 1:
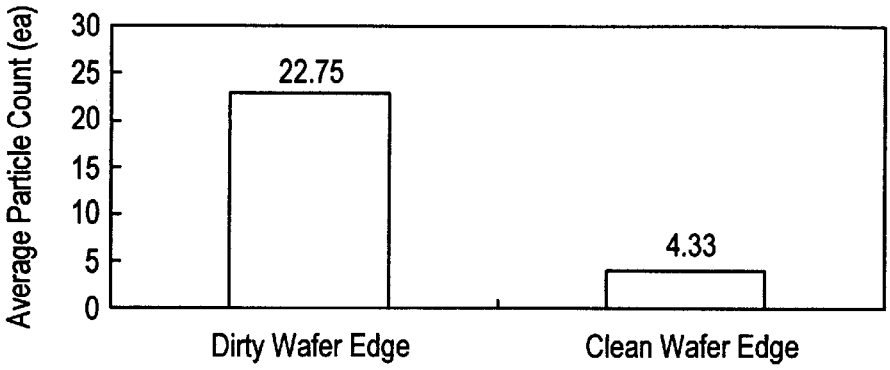
FIG. 1 is a bar chart showing the average number of defects in a wafer, in terms of particles less than 3 microns in size for an unpolished clamp ring.
Figure 2:
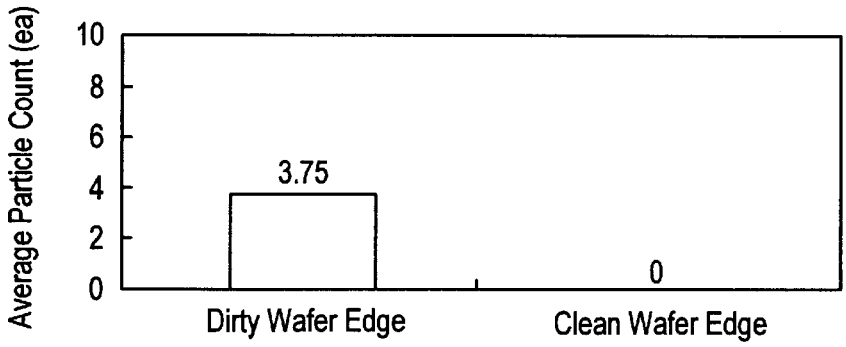
FIG. 2 is a chart similar to FIG. 1 showing average defects in terms of the count of particles greater than 3 microns in size.

Referring first to FIGS. 7–10 the present invention relates to a clamp ring generally indicated by the numeral 18 that is employed in semiconductor manufacturing operations to clamp the outer periphery of a wafer 28 to a pedestal (not shown) or other support within a controlled environment processing chamber (not shown). The clamp ring 18 includes a central, circular opening 20 which exposes the wafer 28 to the processing environment within the chamber. The ring 18 includes a body 22 which is generally smooth on its upper surface and, contains a number of structural features on it lower or bottom side.

Figure 10:
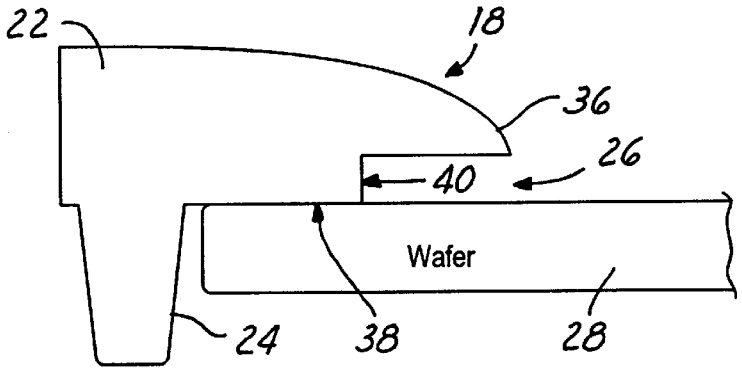
FIG. 10 is a fragmentary, cross sectional view of the clamp ring of FIG. 7 shown in clamping relationship to a wafer.

Defined on the inner periphery of the clamp ring 18 are a series of circumferentially spaced extensions 36, each of which includes a finger-like projections 40 defining clamping pads each having a clamping surface 38 adapted to engage a portion of the upper face of the wafer 28, along the latter's periphery. The circumferential extensions 36 extend outwardly from a circumferentially extending, continuous wall 24, which projects downwardly below the bottom side of the wafer 28, as best seen in FIG. 10. One or more circumferential walls 25 integrally formed with the body 22 provide the clamp ring with structural rigidity. In accordance with the present invention, it has been found that the surface roughness of the clamping surface 38 is directly related to the quality of the processed wafer, and processing defects that reduce quality, and thus production yield. Gouges, scratches and other surface imperfections present on the clamping surface 38 can imprint themselves into the surface of the wafer 28 during the clamping process, resulting in undesirable surface features in the wafer 28. Perhaps even more importantly, a rough or uneven clamping surface 38 has a tendency to break off small particles on the surface of the wafer 28 during the clamping process, and these particles become contaminants that migrate onto other areas of the surface of the wafer 28 being processed. Such particles can remain in the processing chamber and descend on the surface of wafers 28 in subsequent batches. In any event, these particular related surface defects become multilayer defects as a series of layers of metal film are subsequently deposited over the wafer 28. These multilayered defects cause metal line defocusing and bridging between circuit patterns that can result in yield losses of 10% or more. It has been found that there is a direct correlation between the roughness of the clamping surface 38 and the number and severity of wafer defects. The rougher the clamping surface 38, the more defects are present. It has been found that there is also a direct correlation between the roughness of the camping surface 38 and the number and severity of the defects, as a function of the number of particles that are present. In other words, the dirtier the wafer edge is, the more defects are present, and the more severe are such defects.

The above discussed findings are better understood with reference to FIGS. 1–6 which are bar charts showing the relationship between wafer surface defects, their severity and smoothness of the clamp ring surfaces 38. As shown in FIG. 1, measurements were taken of the number of contaminating particulates found on the surface of a wafer, for a large sampling of wafers in several batches. It was found that if a wafer edge classified as being relatively dirty contained about 5 times the average number of particulates as a wafer edge that was classified as clean. The chart shown for FIG. 1 relates to particles that were less than 3 microns in size. A similar chart shown in FIG. 2 for particles greater than 3 microns in size shows that a clean wafer edge typically will have no such particles while a wafer edge classified as dirty will have from 3 to 4 particles of such size.

Figure 3:
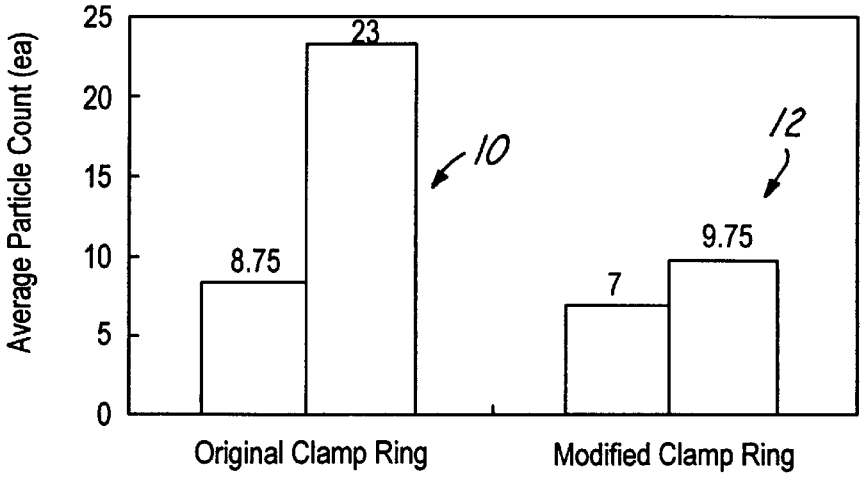
FIG. 3 is a bar chart showing the average number of defects in terms of particles less than 3 microns in size for an unpolished and a polished clamp ring.

FIG. 3 is a bar chart showing the average number of defects for two different processes, and comparing the results of using an unpolished clamp ring versus a polished clamp ring in accordance with the present invention. These results are for defects resulting from particle sizes of less that 3 microns in size. As can be seen from this chart, using an unpolished clamping ring, the average particle count for the two processes was 8.75 and 23 respectively, compared to average particle counts of 7 and 9.75 for the same two processes when using a clamp ring having surfaces polished in accordance with the present invention.

Figure 4:
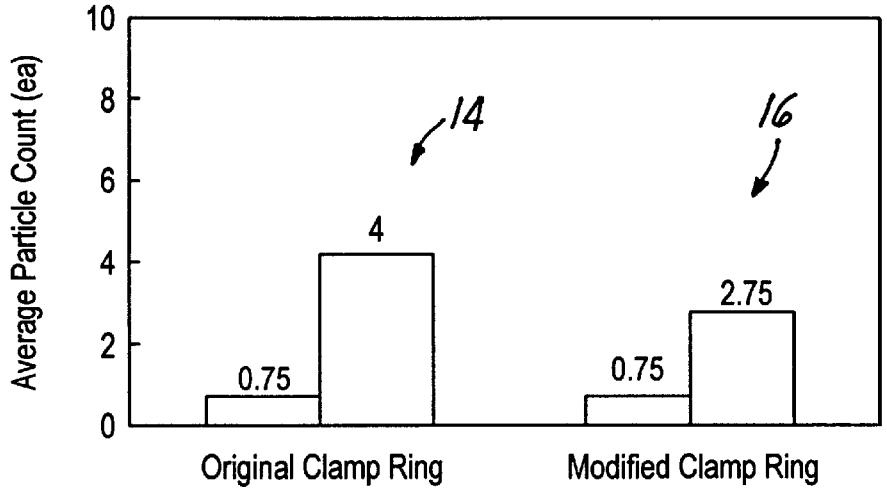
FIG. 4 is a view similar to FIG. 3 but showing average defects in terms of the count of particles greater than 3 microns in size.

FIG. 4 is a bar chart similar to FIG. 3, showing the results for surface defects resulting from surface particulates larger than 3 microns in size. From FIGS. 3 and 4, it may be appreciated that the defect improvement achieved by the polished clamping surfaces in accordance with the present invention will vary with the particular process used, and the number and size of the particulates present on the wafer. However, these results clearly show a marked improvement in wafer processing quality as a result of the present invention.

Figure 5:
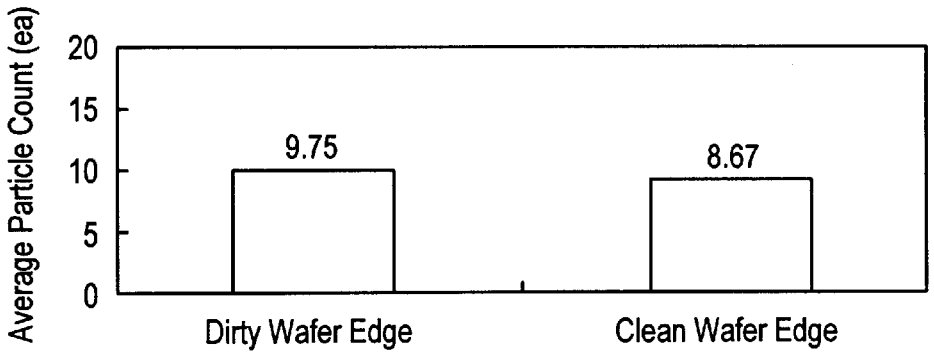
FIG. 5 is a bar chart showing the average number of wafer defects in terms of particles less than 3 microns in size resulting from the use of the polished clamp ring for both wafers having a dirty edge and wafers having a clean edge.
Figure 6:
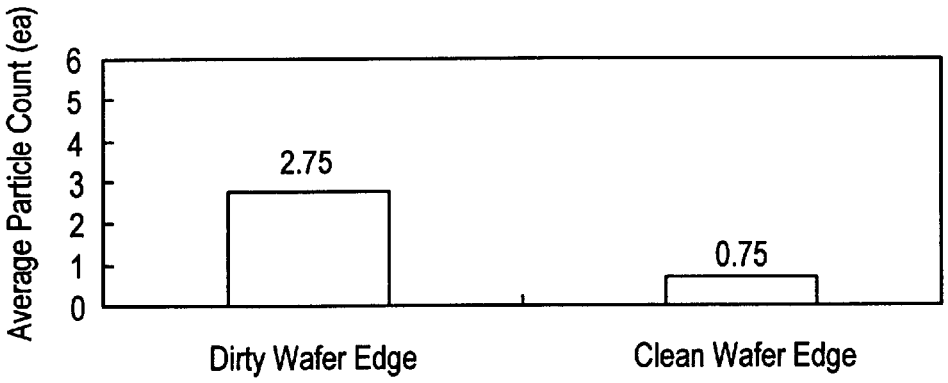
FIG. 6 is a view similar to FIG. 5 but showing average wafer defects in terms of the count of particles greater than 3 microns in size.
Figure 7:
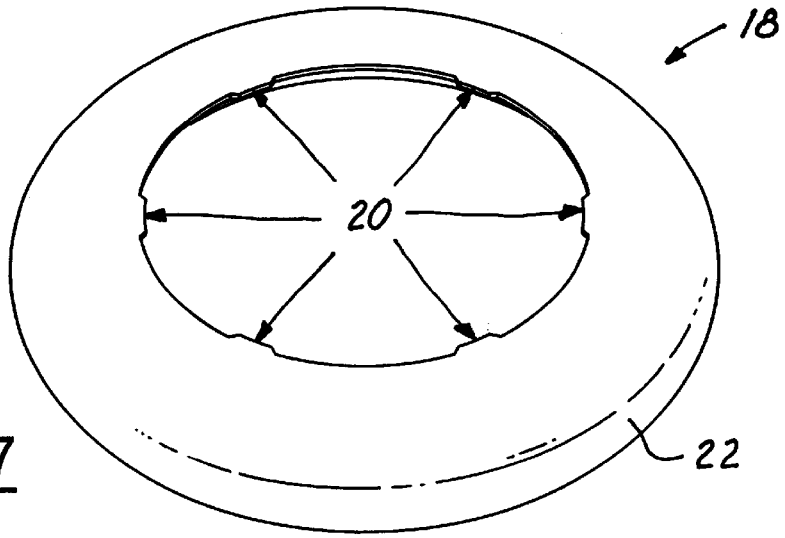
FIG. 7 is a perspective view of a clamp ring to be polished in accordance with the method of the present invention.
Figure 8:
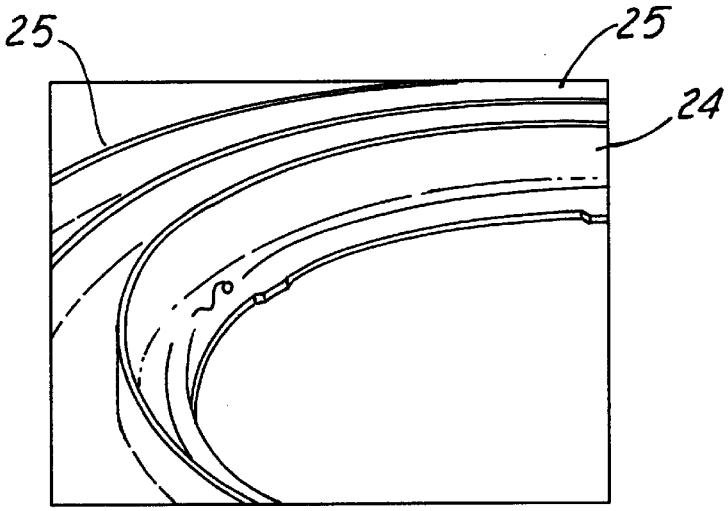
FIG. 8 is a fragmentary, enlarged perspective view of the bottom side of the clamp ring shown in FIG. 7.
Figure 9:
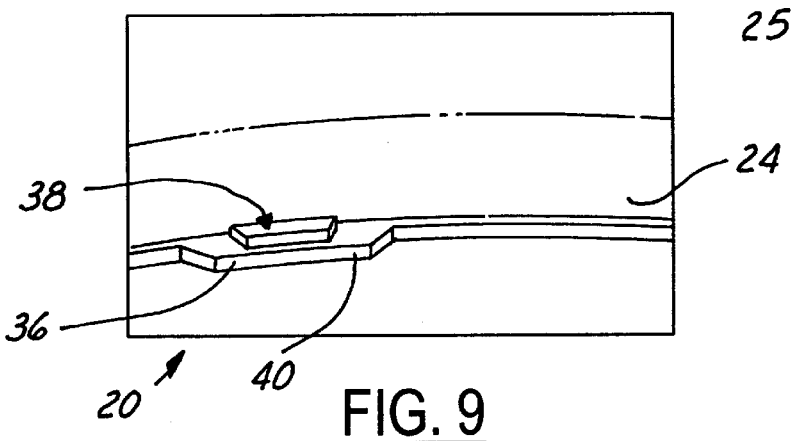
FIG. 9 is a fragmentary, enlarged perspective view of a section of the clamp ring shown in FIG. 8, depicting the details of the intermittent finger pads that engage the wafer.

FIGS. 5 and 6 simply show the incidence of surface defects when using the polished clamp ring of the present invention in relation to wafers having clean vs. dirty edges. As shown in FIG. 5, the number of surface defects resulting from wafers having relatively dirty edges was only marginally greater than that for wafers having a relatively clean edge, for particle sizes less than 3 microns. For particles greater than 3 microns in size, as shown in FIG. 6, however, the number of surface defects for wafers having relatively dirty edges was significantly greater than those resulting from wafers having relatively clean edges.

Referring now again to FIGS. 7–10, the body 22 of clamp ring 22 includes an inner peripheral edge 36 having a cut away section 26 therebeneath which allows passage of processing gasses to reach the outer periphery of the wafer 28, adjacent the clamp pads 40. As previously discussed, foreign, contaminating particles resting on the upper surface of the wafer 28 along the outer periphery of latter may be clamped between the wafer and the pad 40 during a clamping procedure, thus forcing these particles into the wafer surface. Such foreign particles, along with surface imperfections in the clamping surface 38 can also result in stress concentrations on the surface of the wafer 28 which can cause crazing or cracking on the wafer surface, thus resulting in defects in the processed wafer.

Figure 11:
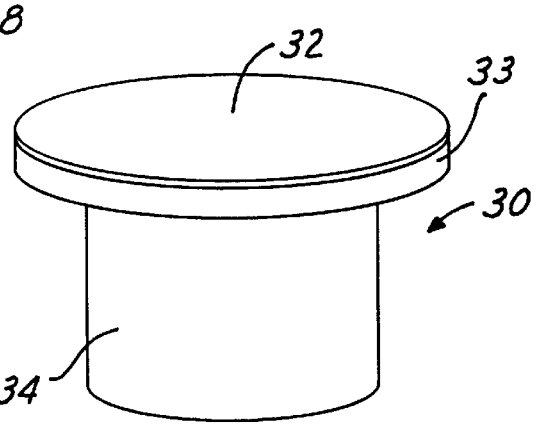
FIG. 11 is a perspective view of a device for polishing a clamp ring in accordance with the present invention.

In accordance with the present invention, it has been found that polishing of the clamping surface 38 significantly reduces stress concentrations, and the likelihood that foreign particles will be become embedded in the surface of the wafer 28. Such polishing can be performed using any of various means, including the use of a polishing pad, polishing paper, etching and the like. However, in accordance with the preferred embodiment of the present invention, a clamp ring polishing tool generally indicated by the numeral 30 in FIG. 11 is provided for polishing the clamp ring 18. The polishing tool 30 includes a generally cylindrical support base 34, and a circular polishing head 33 mounted on top of the pedestal support 34. The polishing head 33 had a diameter substantially identical to that of the wafer 28. A polishing paper 32 is adhered to the upper surface of polishing head 33, which includes a polishing material around the outer edges thereof. The polishing material may consist of a silicon carbide diamond based material. The polishing head 33 may be for example, 5 mm thick and may be formed of a suitable metal such as stainless steel.

Figure 12:
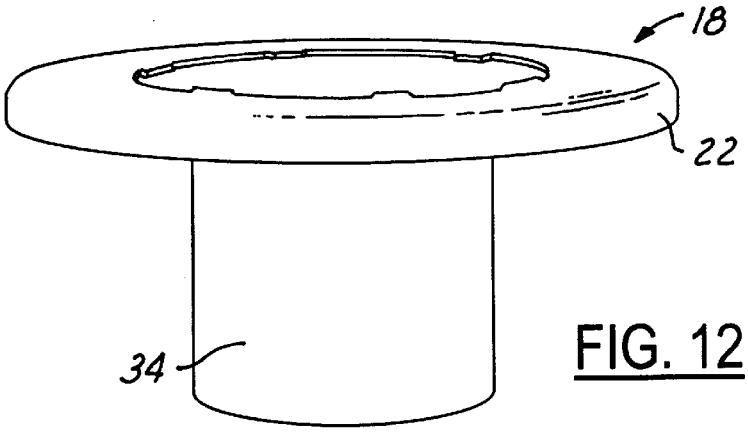
FIG. 12 is a perspective view showing the clamp ring disposed on the polishing device of FIG. 11, in readiness for a polishing operation; and, FIG. 13 is a flow chart showing the various steps for refurbishing a clamp ring in accordance with the present invention.

The use of the polishing tool 30 is shown in FIG. 12. The clamp ring 18 is disposed on the top of the polishing head 33, with the clamp surfaces 38 in face to face engagement with the outer periphery of a polishing paper 32. An axial force is then applied so as to urge the clamp ring 18 and polishing head 33 together, whereupon the clamp ring 18 and tool 30 are rotated relative to each other to produce a polishing action. If desired, any of a number of well-known flowable polishing mediums may be introduced into the interface between the clamping surfaces 38 and the polishing head 33, so as to further increase the resulting surface finish of the clamping surfaces 38.

Figure 13:
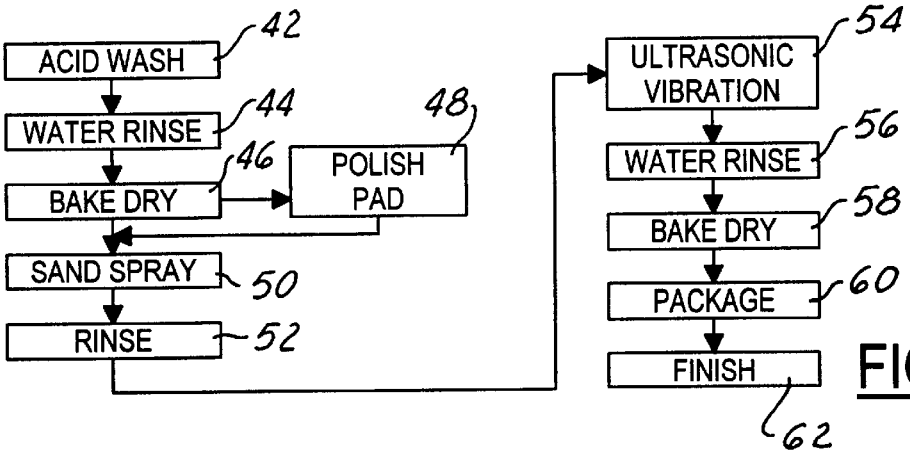

Polishing of the clamp ring 18 may be conducted as a part of periodic maintenance or refurbishment of the clamp ring 18, and the process of such refurbishment is depicted in FIG. 13. After removal of the clamp ring 18 from the associated chamber apparatus, the clamp ring is first acid washed at 42 following which it is rinsed with water at 44 and then bake dried at 46. Following the drying step, the clamping pads of the ring 18 are polished at 46, and in accordance with the previously described method. Following the polishing step, the clamp ring is sand sprayed at 50 and then rinsed at 52. Then, the clamp ring is submitted to ultra-sonic vibration at 54 following which it is water rinsed at 56 and bake dried at 58. The clamp ring may then be packaged in a carrier fixture at 60, thus ending the refurbishment procedure at 62.

From the foregoing, it is apparent that the method and apparatus described above not only provide for the reliable accomplishment of the objects of the invention but do so in a peculiarly efficient and economical manner. It is recognized, of course, that those skilled in the art may make various modifications or additions to the preferred embodiment chosen to illustrate the invention without departing from the spirit and scope of the present contribution to the art. Accordingly, it is to be understood that the protection sought and to be afforded hereby should be deemed to extend to the subject matter claimed and all equivalents thereof fairly within the scope of the invention.

What is claimed is:

1. A method for reducing defects in a semiconductor wafer caused by a clamp ring used to clamp the edge of said wafer during processing thereof, comprising the steps of:

polishing a surface of said clamp ring used to engage said wafer edge during clamping of said wafer by placing said clamp ring on a polishing tool with said clamp ring surface in face-to-face contact with a polishing surface on said tool, and relatively moving said clamp ring and said tool by turning said clamp ring and said tool relative to each other, whereby said polishing tool surface polishes said clamp ring surface.

2. The method of claim 1, including the step of introducing a flowable polishing abrasive material between clamp said clamp ring surface and said tool.

3. The method of claim 2 including the step of selecting silicon carbide diamond as said abrasive material.

4. The method of claim 1, including the step of providing a polishing tool for performing said polishing of said clamp ring surface.

5. The method of claim 4, wherein said step of providing said polishing includes forming a rigid circular polishing head and mounting said head such that said clamp ring may be supported on top of said head.

6. The method of claim 5, wherein said polishing is performed by introducing a polishing abrasive between said clamp ring surface and said head and rotating said clamp ring on said head.

7. A method of reducing defects in the semiconductor wafer caused by a clamp ring used to clamp the edge of said wafer during processing of said wafer, comprising the steps of:

providing a polishing tool having a flat, circular polishing surface;

placing said clamp ring on said tool with the clamping surfaces of said ring used to clamp said wafer in face-to-face contact of said polishing surface;

relatively rotating said tool and said clamp ring urging said clamp ring and said tool by rotating said clamp ring while said tool remains stationary toward each other using an axial force; whereby to polish said clamp ring surfaces.

8. The method of claim 7, including the steps of introducing a flowable abrasive polishing material between said clamp ring surfaces and said polishing surface.

9. A method of refurbishing a clamp ring used clamp the edge of a semiconductor wafer during processing of said wafer comprising of steps of:

removing said clamp ring from and apparatus used to process said wafer;

cleaning said clamp ring;

polishing a clamping surface of said ring used to engage a face of said wafer; and, reinstalling said clamp ring on said apparatus.

10. The method of claim 9, wherein said cleaning step include washing and drying said ring, and said polishing is performed after said drying.

11. The method of claim 10, wherein said cleaning step includes, after polishing said ring surface, subjecting said ring to a sand spray.

12. The method of claim 9, wherein said polishing is performed by placing said clamp ring on a polishing tool and relatively rotating said ring and said tool.

13. The method of claim 12, wherein said polishing includes forcing said tool and said ring into face-to-face contact while relatively rotating said ring and said tool.

* * * * *